US006459860B1

(12) United States Patent
Childers

(10) Patent No.: US 6,459,860 B1
(45) Date of Patent: Oct. 1, 2002

(54) REPLACEABLE PRINTER COMPONENT INCLUDING MEMORY DEVICE THAT DEFINES PRINTING CAPABILITIES

(75) Inventor: Winthrop D. Childers, San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/802,507

(22) Filed: Mar. 8, 2001

(51) Int. Cl.[7] ..... G03G 15/00

(52) U.S. Cl. ..... 399/12; 399/24; 399/25; 399/81

(58) Field of Search ..... 399/8, 9, 11, 12, 399/13, 24, 25, 27, 81; 347/5, 7, 9, 14, 86

(56) References Cited

U.S. PATENT DOCUMENTS 4,961,088 A * 10/1990 Gilliland et al. ..... 399/25
5,491,540 A 2/1996 Hirst
5,572,292 A * 11/1996 Chatani et al. ..... 399/25
5,682,140 A 10/1997 Christensen et al.
5,699,091 A 12/1997 Bullock et al.
5,708,912 A * 1/1998 Lee ..... 399/24
5,812,156 A 9/1998 Bullock et al.
5,835,817 A 11/1998 Bullock et al.
5,930,553 A 7/1999 Hirst et al.
5,956,541 A * 9/1999 Hoshika et al. ..... 399/24
6,019,461 A * 2/2000 Yoshimura et al. ..... 347/86
6,039,430 A 3/2000 Helterline et al.
6,053,597 A * 4/2000 Hirota ..... 399/12 X
6,113,208 A 9/2000 Benjamin et al.
6,126,265 A 10/2000 Childers et al.

* cited by examiner

*Primary Examiner*—Sandra Brase

(57) ABSTRACT

A replaceable printer component adapted for use in a printing system includes a memory device and a communication link adapted to communicate the memory device with a printer controller for the printing system when the replaceable printer component is installed in the printing system. The memory device has an interface identifier stored therein which corresponds with a user interface for the printing system. Since the user interface presents printing capabilities of the printing system, the replaceable printer component defines which printing capabilities are available to a user of the printing system.

33 Claims, 2 Drawing Sheets

REPLACEABLE PRINTER COMPONENT INCLUDING MEMORY DEVICE THAT DEFINES PRINTING CAPABILITIES

FIELD OF THE INVENTION

The present invention relates generally to printing systems and, more particularly, to a replaceable printer component that identifies a user interface for a printing system.

BACKGROUND OF THE INVENTION

Printing systems are commonly designed so as to appeal to the largest number of potential users. As such, printing systems are typically designed for general purpose printing. To initiate printing with such systems, users typically interact with a user interface which presents printing capabilities such as print properties and/or print options of a printing system. Thus, user interfaces which define printing capabilities for printing systems are usually adapted for use by average users who have general purpose printing needs.

Printing systems also commonly make use of replaceable components. Replaceable components include, for example, ink containers, printheads, printer cartridges, and/or toner cartridges. Such components, however, are also typically designed for general purpose printing. More specifically, replaceable components are often designed for use by an average user for general purpose printing at a normal level of performance. Thus, user interfaces and, therefore, presentations of printing capabilities for printing systems incorporating such components are usually adapted for general purpose printing.

Replaceable components for print systems, however, may be designed for specific users, specific applications or uses, and/or specific performance levels. Thus, the ability to present multiple user interfaces and, therefore, multiple printing capabilities for a printing system based, for example, on users, uses, and/or performance of replaceable components would enhance the flexibility of the printing system.

Accordingly, a need exists for identifying multiple user interfaces and, therefore, defining multiple printing capabilities for a printing system. More particularly, a need exists for a printing system which utilizes a replaceable printer component which identifies a user interface and, therefore, defines printing capabilities for the printing system in which the replaceable printer component is installed.

SUMMARY OF THE INVENTION

One aspect of the present invention provides a replaceable printer component. The replaceable printer component is adapted for use in a printing system having a printer controller configured to control operation of the printing system. The replaceable printer component includes a memory device having an interface identifier stored therein and a communication link adapted to communicate the memory device with the printer controller when the replaceable printer component is installed in the printing system. As such, the interface identifier corresponds with a user interface for the printing system.

In one embodiment, the communication link is adapted to communicate the interface identifier with the printer controller.

In one embodiment, the interface identifier corresponds with at least one of a plurality of user interfaces for the printing system. In one embodiment, each of the user interfaces presents at least one printing capability of the printing system.

In one embodiment, the replaceable printer component is an ink container. In one embodiment, the replaceable printer component is a printhead. In one embodiment, the replaceable printer component is a printer cartridge including an ink container and a printhead. In one embodiment, the replaceable printer component is a toner cartridge.

Another aspect of the present invention provides a printing system. The printing system includes a printer controller and a replaceable printer component including a memory device having an interface identifier stored therein. As such, the memory device is adapted to communicate with and transfer the interface identifier to the printer controller when the replaceable printer component is installed in the printing system.

Another aspect of the present invention provides a printing arrangement. The printing arrangement includes a host processor having a plurality of user interfaces stored therein, a replaceable printer component communicating with the host processor and including a memory device having an interface identifier stored therein which corresponds with at least one of the user interfaces, and a display device communicating with the host processor and configured to display the at least one of the user interfaces.

Another aspect of the present invention provides a method of selecting a user interface from a plurality of user interfaces for a printing system. The method includes providing a host processor having the user interfaces stored therein and providing a replaceable printer component including a memory device having an interface identifier stored therein. As such, the interface identifier corresponds with at least one of the user interfaces stored in the host processor.

The present invention provides a replaceable printer component for use in a printing system. The replaceable printer component includes a memory device which identifies a user interface for and, therefore, defines printing capabilities of the printing system. In addition, the present invention provides a printing system and arrangement which utilizes a replaceable printer component to define printing capabilities of the printing system by identifying a user interface for the printing system in which the replaceable printer component is installed.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
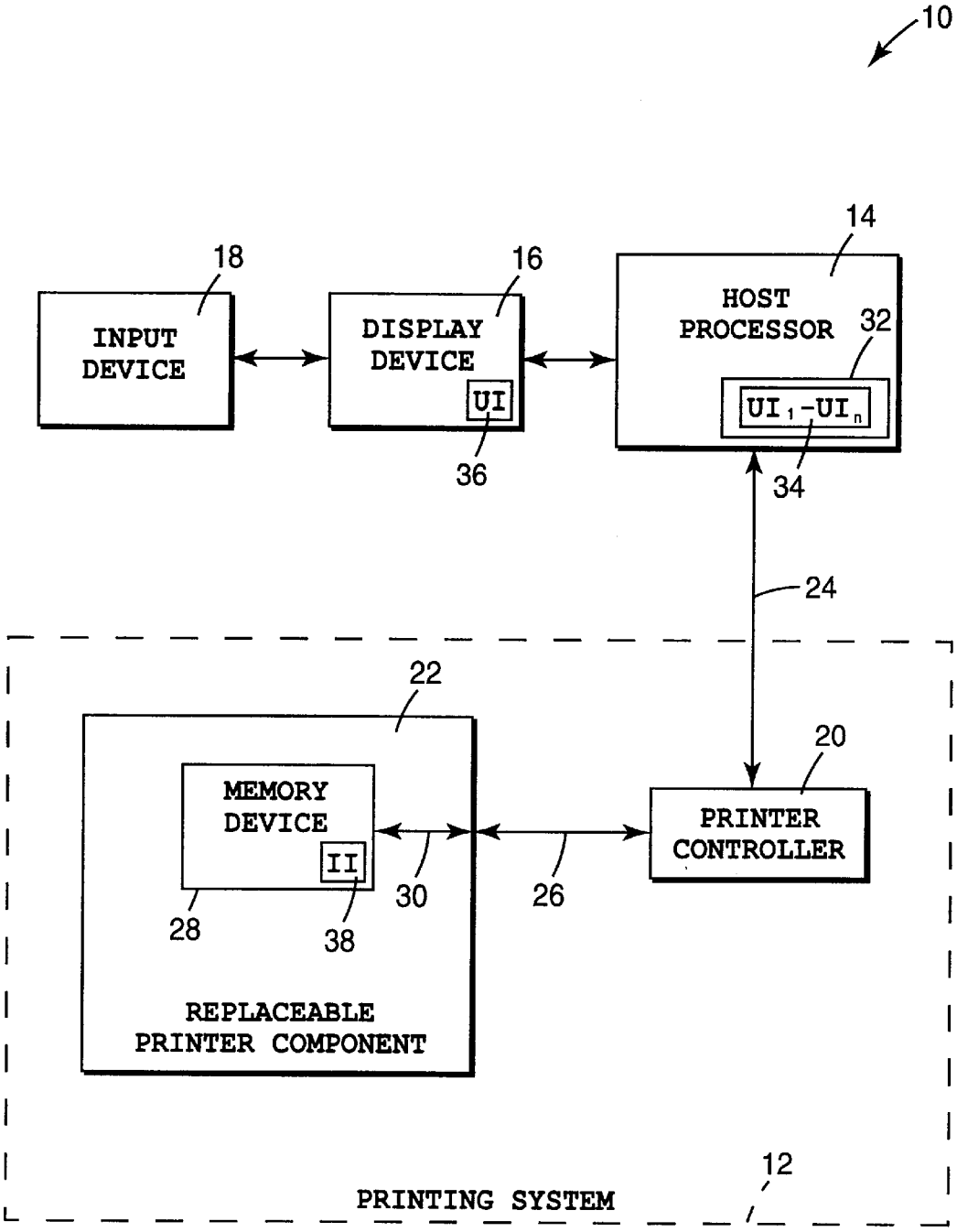
FIG. 1 is a schematic illustration of one embodiment of a printing arrangement according to the present invention.

FIG. 1 illustrates one embodiment of a portion of a printing arrangement 10 according to the present invention. Printing arrangement 10 includes a printing system 12, a host processor 14, a display device 16, and an input device 18. Printing system 12 facilitates printing of graphical and/or textural images on a print medium, such as paper. Printing system 12 may include, for example, an inkjet printer, a laser printer, etc. Host processor 14 communicates with printing system 12 and provides data and/or control signals to printing system 12. Host processor 14 can be or can be included in a variety of information sources such as a computer, appliance, or other device such as a personal digital assistant (PDA), digital camera, cellular phone, etc. Display device 16 communicates with host processor 14 and displays information communicated from host processor 14. Display device 16 can include a screen, monitor, or other device that presents information in visual form. Input device 18 communicates with display device 16 and enables a user of printing arrangement 10 to interact with display device 16 and, therefore, host processor 14. Input device 18 can include a keyboard, touch screen, mouse, or other screen-positioning device for input and/or selection of commands and/or functions for printing arrangement 10.

In one embodiment, printing system 12 includes a printer controller 20 and a replaceable printer component 22. Printer controller 20 controls operation of printing system 12 and, as such, receives data and/or control signals from host processor 14. Printer controller 20 communicates with host processor 14 via a communication link 24. Communication link 24 includes, for example, an electrical, optical, infrared, or other information transfer path between printer controller 20 and host processor 14.

Replaceable printer component 22 includes a component of printing system 12 which is insertable in and removable from printing system 12. In one embodiment, replaceable printer component 22 includes a consumable component which is disposed of and replaced at an end of a useful life thereof. An example of such a consumable component includes an ink container or a toner cartridge which contains a supply of marking material for printing system 12. The marking material is deposited on a print medium by printing system 12 and depleted during a useful life of the ink container or toner cartridge. As such, the ink container or toner cartridge is disposed of and replaced at an end of a useful life thereof.

In addition, replaceable printer component 22 also includes a printing component which is readily replaced in printing system 12. Examples of such a printing component include a printhead which selectively deposits ink on a print medium in response to control signals from printer controller 20 or a printer cartridge which includes a printhead and an ink supply. Thus, replaceable printer component 22 may include an ink container, a printhead, or a printer cartridge if, for example, printing system 12 includes an inkjet printer. In addition, replaceable printer component 22 may include a toner cartridge if, for example, printing system 12 includes a laser printer.

Printer control 20 and replaceable printer component 22 communicate with each other via a communication link 26. Communication link 26 facilitates information transfer between printer controller 20 and replaceable printer component 22 when replaceable printer component 22 is installed in printing system 12. Communication link 26 includes, for example, an electrical, optical, infrared, or other information transfer path between replaceable printer component 22 and printer controller 20.

Replaceable printer component 22 includes a memory device 28 which stores information for replaceable printer component 22 and/or printing system 12. More specifically, memory device 28 can store, for example, information which is specific to replaceable printer component 22 and/or information which is applicable to printing system 12. In addition, memory device 28 can have information to be used by printing system 12 stored therein or can record information for printing system 12. Furthermore, information which may be stored in memory device 28 includes operational and/or non-operational parameters as described, for example, in U.S. Pat. No. 6,039,430 entitled "Method and Apparatus for Storing and Retrieving Information on a Replaceable Printing Component" assigned to the assignee of the present invention and incorporated herein by reference.

In one embodiment, replaceable printer component 22 includes a communication link 30 which electrically couples or communicates memory device 28 with communication link 26 and, therefore, printer controller 20 when replaceable printer component 22 is installed in printing system 12. As such, when replaceable printer component 22 is installed in printing system 12, memory device 28 communicates with printer controller 20 via communication links 26 and 30. Thus, communication links 26 and 30 include, for example, electrical couplings or connections such as electrical contacts or pins which mate with corresponding electrical nodes or receptacles, respectively.

In one embodiment, host processor 14 includes a printer driver 32 for printing system 12. Printer driver 32 is installed in host processor 14 and provides interaction with printing system 12. As such, printer driver 32 includes various parameters for controlling operation of printing system 12. Printer driver 32 includes, for example, print properties and/or print options which define a printing capability of printing system 12.

In one embodiment, printer driver 32 includes a plurality of user interfaces ($UI_l$–$UI_n$) 34 which present various parameters for controlling printing system 12. More specifically, user interfaces 34 present printing capabilities of printing system 12 to a user of printing arrangement 10. Printing capabilities of printing system 12 include, for example, print properties and/or print options of printing system 12. More specifically, printing capabilities of printing system 12 include, for example, print medium size and/or type, printing layout, printing quality, color printing. As such, user interfaces 34 each present various combinations of printing capabilities of printing system 12 to a user of printing arrangement 10.

For example, user interfaces 34 each identify different print properties and/or print options for printing system 12 or different combinations of print properties and/or print options for printing system 12. The different print properties and/or print options or combinations thereof presented in user interfaces 34 are based, for example, on an intended use or user of printing system 12, an expected performance of printing system 12, or a desired feature or features of printing system 12.

Host processor 14 conveys at least one user interface (UI) 36 of user interfaces 34 to display device 16 for visual presentation to a user of printing arrangement 10. In one embodiment, user interface 36 presents printing capabilities including print properties and/or print options of printing system 12 as, for example, open input fields, pull-down menus, toggle selections, and/or highlighted or framed selections. In addition, user interface 36 presents print properties and/or print options for printing system 12 in one or more screens or views on display device 16. As such, a user of printing arrangement 10 can interact with user interface 36 displayed on display device 16 via input device 18. A user of printing arrangement 10, therefore, can select and/or specify features or, more specifically, print properties and/or print options of printing system 12 for a print job.

In one embodiment, memory device 28 of replaceable printer component 22 has an interface identifier (II) 38 stored therein. Interface identifier 38 corresponds to one or more user interfaces 34 stored in host processor 14. As such, replaceable printer component 22 identifies which user interface 36 of user interfaces 34 is to be accessed by host processor 14 and displayed by display device 16. Thus, since user interfaces 34 represent different printing capabilities of printing system 12, interface identifier 38 also identifies which printing capabilities of printing system 12 are available to a user of printing arrangement 10. If more than one user interface is identified by replaceable printer component 22, a user of printing arrangement 10 can select a desired user interface from those identified.

Since memory device 28 and, therefore, interface identifier 38 are included in replaceable printer component 22, interface identifier 38 is communicated to printer controller 20 and host processor 14 when replaceable printer component 22 is installed in printing system 12. Interface identifier 38 is communicated to printer controller 20 via communication links 26 and 30 and communicated to host processor 14 from printer controller 20 via communication link 24. In one embodiment, printer controller 20 reads interface identifier 38 from memory device 28 when replaceable printer component 22 is installed in printing system 12.

In one embodiment, replaceable printer component 22 is designed to achieve specific printing objectives. Replaceable printer component 22 may be designed, for example, for a targeted user, an intended application or use, or a specific level of performance. Replaceable printer component 22, therefore, includes interface identifier 38 which identifies one or more user interfaces 34 which correspond to a specific printing objective. More specifically, interface identifier 38 identifies one or more user interfaces 34 which present printing capabilities of printing system 12 corresponding to the specific printing objective. Thus, replaceable printer components 22 designed to achieve different printing objectives can be easily incorporated into printing system 12.

One example of replaceable printer component 22 designed to achieve a specific printing objective includes a printer cartridge designed for photographic quality printing. As such, interface identifier 38 of replaceable printer component 22 identifies user interface 36 which includes and presents printing capabilities of printing system 12 that are associated with photographic quality printing. Such printing capabilities may identify, for example, high quality print mode capabilities and may include, for example, photographic-specific printing capabilities such as color balancing, photo cropping and/or sizing, photo duplication, etc. Thus, interface identifier 38 identifies which user interface 36 of printer driver 32 stored on host processor 14 is to be displayed on display device 16 for photographic quality printing.

Another example of replaceable printer component 22 designed to achieve a specific printing objective includes a printer cartridge designed for use by a child. As such, interface identifier 38 of replaceable printer component 22 identifies user interface 36 which includes and presents printing capabilities of printing system 12 that are easily understood by a child. Such printing capabilities may include, for example, economy print mode capabilities and may present printing capabilities of printing system 12 in a simple and/or intuitive manner. Color printing options for printing system 12, for example, may be represented with a color pinwheel. In addition, a number of copies to be printed with printing system 12 may be presented as large numerals (e.g., "1", "2", "3", etc.) which may be selectively highlighted. Furthermore, user interface 36 may offer verbal instructions to a user thus enabling a child to use printing system 12 even though the child may not yet know how to read.

By installing different replaceable printer components 22 in printing system 12, different user interfaces 34 and, therefore, different printing capabilities of printing system 12 are available to a user of printing system 12. As such, printing system 12 can be used to fulfill different printing objectives. Thus, user interfaces 34 and, therefore, printing capabilities of printing system 12 may be targeted for specific users, specific applications or uses, and/or specific performance levels. For example, user interfaces 34 may be targeted for proficient computer users or timid or new computer users such as children, high quality, best mode printing or economy mode printing, or general office printing, graphic arts printing, or photographic printing.

With user interfaces 34 targeted for specific users, specific applications or uses, and/or specific performance levels, replaceable printer component 22 may be designed for specialized and/or segmented consumer markets. If, for example, replaceable printer component 22 is designed for photographic quality printing, as described above, interface identifier 38 of replaceable printer component 22 may identify user interface 36 which includes and presents printing capabilities that are preferred by a professional photographer as opposed to those preferred by an average consumer.

Printing capabilities that are preferred by a professional photographer may include, for example, color accuracy and resolution. Since resolution usually decreases as color accuracy improves, replaceable printer component 22 may be configured for use by a professional photographer who understands and has the skill to balance a tradeoff between color accuracy and resolution. As such, replaceable printer component 22 may identify user interface 36 which allows colors to be selected very accurately so as to enable a user to make a quantified decision on balancing color accuracy and resolution.

Although also interested in photographic quality printing, an average consumer, however, may prefer that printing system 12 and/or host processor 14 automatically make the tradeoff between color accuracy and resolution. While the average consumer may want some control over printing capabilities including color accuracy and resolution, replaceable printer component 22 may identify user interface 36 which presents such printing capabilities in a much simpler and/or more intuitive manner. Color accuracy and resolution may be represented, for example, by options such as "more green", "less yellow", etc. rather than more quantitative commands.

With replaceable printer component 22 designed for specialized and/or segmented consumer markets, interface identifier 38 may be based on a targeted sales channel. If, for example, replaceable printer component 22 is designed for a professional photographer, as described above, the professional photographer may purchase replaceable printer component 22 from a specialty retailer or wholesaler of equipment and/or supplies for professional photographers. Thus, interface identifier 38 of replaceable printer component 22 for sale by the specialty retailer or wholesaler may identify user interface 36 which is configured for use by the professional photographer.

If, however, replaceable printer component 22 is designed for an average consumer, the average consumer may purchase replaceable printer component 22 from a mass retailer such as a discount store or mass market Internet retailer which sells products to consumers at large. Thus, interface identifier 38 of replaceable printer component 22 for sale by the mass retailer may identify user interface 36 which is configured for general purpose printing. Accordingly, one method of designing replaceable printer component 22 is to include interface identifier 38 which is specific to an intended sales channel for replaceable printer component 22 such that user interface 36 identified by interface identifier 38 corresponds with users of the intended sales channel.

Figure 2:
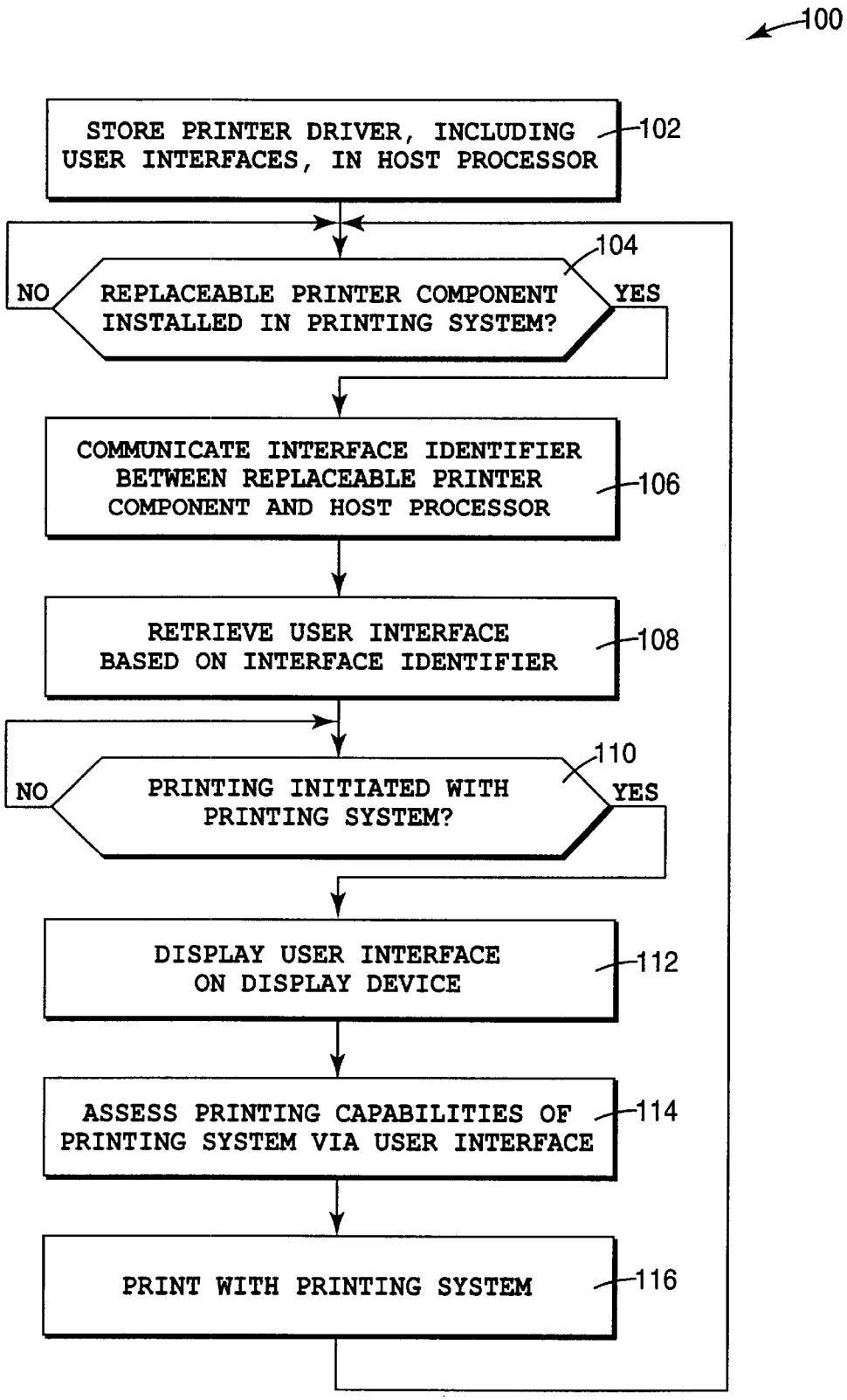
FIG. 2 is a flow diagram illustrating one embodiment of a method of selecting a user interface for a printing system according to the present invention.

FIG. 2 illustrates one embodiment of a method 100 of selecting user interface 36 for printing system 12 and, therefore, presenting printing capabilities of printing system 12 to a user of printing arrangement 10. At step 102, printer driver 32, including user interfaces 34, is stored in host processor 14. Printer driver 32, for example, may be loaded onto host processor 14 from a CD-ROM (Compact Disk Read Only Memory) or floppy disk or may be downloaded onto processor 14 from an Internet site. In addition, printer driver 32 may be packaged with replaceable printer component 22. Printer driver 32 may be loaded, for example, on a hard drive included with host processor 14.

At step 104, whether replaceable printer component 22 is installed in printing system 12 is assessed. If replaceable printer component 22 is not installed in printing system 12, method 100 returns. If, however, replaceable printer component 22 is installed in printing system 12, method 100 proceeds to step 106. Once replaceable printer component 22 is initially installed in printing system 12, step 104 assesses whether a different replaceable printer component 22 is installed in printing system 12.

At step 106, when replaceable printer component 22 is installed in printing system 12, interface identifier 38 from memory device 28 of replaceable printer component 22 is communicated to host processor 14. More specifically, interface identifier 38 is communicated to printer controller 20 of printing system 12 via communication links 26 and 30 and communicated to host processor 14 of printing arrangement 10 via communication link 24, as illustrated in FIG. 1. In one embodiment, interface identifier 38 is read from memory device 28 by printer controller 20 once replaceable printer component 22 is installed in printing system 12.

At step 108, user interface 36 is retrieved from user interfaces 34 stored on host processor 14. User interface 36 is identified based on interface identifier 38 from memory device 28 of replaceable printer component 22. It is understood that one or more user interfaces 34 may be retrieved based on interface identifier 38. If so, a user of printing system 12 selects a desired user interface.

At step 110, whether printing with printing system 12 has been initiated is assessed. Printing may be initiated, for example, by selecting "File/Print . . . " in a program or application running on host processor 14. If printing has not been initiated, method 100 returns. If, however, printing with printing system 12 has been initiated, method 100 proceeds to step 112. It is understood that step 110 may occur before steps 106 and 108 such that interface identifier 38 is communicated to host processor 14 and user interface 36 is retrieved based on interface identifier 38 once printing with printing system 12 is initiated.

At step 112, user interface 36, as identified and retrieved from user interfaces 34 in step 108, is displayed for a user of printing arrangement 10. User interface 36 is displayed on display device 16, as illustrated in FIG. 1.

At step 114, a user of printing arrangement 10 assesses printing capabilities of printing system 12 from user interface 36. As such, a user of printing arrangement 10 interacts with user interface 36 via input device 18 to select and/or specify print properties and/or print options for a print job via user interface 36.

At step 116, printing of print job with printing system 12 is completed. Printing is performed in accordance with the print properties and/or print options specified and/or selected in step 114. Thereafter, method 100 returns to step 104.

By including interface identifier 38 in memory device 28, replaceable printer component 22 automatically identifies which user interface 36 should be displayed for printing system 12 when replaceable printer component 22 is installed in printing system 12. Since user interface 36 presents printing capabilities of printing system 12, replaceable printer component 22 defines which printing capabilities of printing system 12 are available to a user of printing system 12. Thus, printing capabilities of printing system 12 which are applicable to replaceable printer component 22 are automatically identified and presented to a user of printing system 12 based on interface identifier 38.

In addition, by including interface identifier 38 in memory device 28, replaceable printer components 22 can be designed to achieve different printing objectives. Replaceable printer components 22 can be designed, for example, for a targeted user, an intended application or use, or a specific level of performance. Thus, different printing objectives can be fulfilled by installing different replaceable printer components 22 in printing system 12. As such, user interface 36 corresponding with replaceable printer component 22 can be automatically identified when replaceable printer component 22 is installed in printing system 12.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electro-mechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A replaceable printer component adapted for use in a printing system having a printer controller configured to control operation of the printing system, the replaceable printer component comprising:

a memory device having an interface identifier stored therein, the interface identifier corresponding with a user interface for the printing system;

a communication link adapted to communicate the memory device with the printer controller when the replaceable printer component is installed in the printing system;

and wherein the user interface corresponds to a specific printing objective including at least one of a targeted user, an intended use, and a level of performance of the printing system.

2. A replaceable printer component adapted for use in a printing system having a printer controller configured to control operation of the printing system, the replaceable printer component comprising:

a memory device having an interface identifier stored therein, the interface identifier corresponding with a user interface for the printing system;

a communication link adapted to communicate the memory device with the printer controller when the replaceable printer component is installed in the printing system;

and wherein the interface identifier is based on a targeted sales channel for the replaceable printer component.

3. A printing system, comprising:

a printer controller;

a replaceable printer component including a memory device having an interface identifier stored therein, wherein the memory device is adapted to communicate with and transfer the interface identifier to the printer controller when the replaceable printer component is installed in the printing system;

wherein the interface identifier corresponds with at least one of a plurality of user interfaces for the printing system;

and wherein at least one of the user interfaces corresponds to a specific printing objective including at least one of a targeted user, an intended use, and a level of performance of the printing system.

4. A printing system, comprising:

a printer controller;

a replaceable printer component including a memory device having an interface identifier stored therein, wherein the memory device is adapted to communicate with and transfer the interface identifier to the printer controller when the replaceable printer component is installed n the printing system;

and wherein the interface identifier is based on a targeted sales channel for the replaceable printer component.

5. A printing arrangement, comprising:

a host processor having a plurality of user interfaces stored therein;

a replaceable printer component communicating with the host processor and including a memory device having an interface identifier stored therein which corresponds with at least one of the user interfaces; and a display device communicating with the host processor and configured to display the at least one of the user interfaces.

6. The printing arrangement of claim 5, further comprising:

a printer controller communicating with the memory device of the replaceable printer component and the host processor, wherein the replaceable printer component communicates with the host processor via the printer controller.

7. The printing arrangement of claim 6, wherein the printer controller is adapted to read the interface identifier from the memory device of the replaceable printer component and communicate the interface identifier with the host processor.

8. The printing arrangement of claim 5, wherein the host processor is adapted to retrieve the at least one of the user interfaces from the plurality of user interfaces based on the interface identifier.

9. The printing arrangement of claim 5, wherein each of the user interfaces presents at least one printing capability of the printing arrangement.

10. The printing arrangement of claim 5, wherein installation of the replaceable printer component in the printing arrangement initiates display of the at least one of the user interfaces.

11. The printing arrangement of claim 5, further comprising:

an input device communicating with the display device and configured to interact with the at least one of the user interfaces.

12. The printing arrangement of claim 5, wherein at least one of the user interfaces corresponds to a specific printing objective including at least one of a targeted user, an intended use, and a level of performance of the printing arrangement.

13. The printing arrangement of claim 5, wherein the interface identifier is based on a targeted sales channel for the replaceable printer component.

14. The printing arrangement of claim 5, wherein the replaceable printer component is an ink container for the printing arrangement.

15. The printing arrangement of claim 5, wherein the replaceable printer component is a printhead for the printing arrangement.

16. The printing arrangement of claim 5, wherein the replaceable printer component is a printer cartridge including an ink container and a printhead for the printing arrangement.

17. The printing arrangement of claim 5, wherein the replaceable printer component is a toner cartridge for the printing arrangement.

18. A method of selecting a user interface from a plurality of user interfaces for a printing system, the method comprising the steps of:

providing a host processor having the user interfaces stored therein; and providing a replaceable printer component including a memory device having an interface identifier stored therein, the interface identifier corresponding with at least one of the user interfaces stored in the host processor.

19. The method of claim 18, wherein the step of providing the replaceable printer component includes installing the replaceable printer component in the printing system.

20. The method of claim 19, wherein installing the replaceable printer component in the printing system initiates retrieval of the at least one of the user interfaces.

21. The method of claim 18, further comprising the step of:

communicating the interface identifier between the replaceable printer component and the host processor.

22. The method of claim 21, wherein the step of communicating the interface identifier includes reading the interface identifier from the memory device of the replaceable printer component.

23. The method of claim 21, further comprising the step of:

communicating a printer controller with the replaceable printer component and the host processor, wherein the step of communicating the interface identifier includes communicating the interface identifier with the host processor via the printer controller.

24. The method of claim 18, further comprising the step of:

retrieving via the host processor the at least one of the user interfaces based on the interface identifier.

25. The method of claim 18, further comprising the step of:

storing the user interfaces in the host processor.

26. The method of claim 18, further comprising the steps of:

communicating a display device with the host processor; and displaying the at least one of the user interfaces on the display device.

27. The method of claim 26, wherein the step of displaying the at least one of the user interfaces includes presenting at least one printing capability of the printing system.

28. The method of claim 18, wherein at least one of the user interfaces corresponds to a specific printing objective including at least one of a targeted user, an intended use, and a level of performance of the printing system.

29. The method of claim 18, wherein the interface identifier is based on a targeted sales channel for the replaceable printer component.

30. The method of claim 18, wherein the step of providing the replaceable printer component includes providing an ink container for the printing system.

31. The method of claim 18, wherein the step of providing the replaceable printer component includes providing a printhead for the printing system.

32. The method of claim 18, wherein the step of providing the replaceable printer component includes providing a printer cartridge including an ink container and a printhead for the printing system.

33. The method of claim 18, wherein the step of providing the replaceable printer component includes providing a toner cartridge for the printing system.

* * * * *

UNITED STATES PATENT AND TRADEMARK OFFICE

CERTIFICATE OF CORRECTION

PATENT NO. : 6,459,860 B1
DATED : October 1, 2002
INVENTOR(S) : Childers

It is certified that error appears in the above-identified patent and that said Letters Patent is hereby corrected as shown below:

Column 9,
Line 36, delete “n” and insert therefor -- in --.

Signed and Sealed this

Thirtieth Day of December, 2003

JAMES E. ROGAN
*Director of the United States Patent and Trademark Office*